US011260263B2

(12) United States Patent
Cook et al.

(10) Patent No.: US 11,260,263 B2
(45) Date of Patent: Mar. 1, 2022

(54) SPINE CORRECTOR HAVING ADJUSTABLE HANDLES

(71) Applicant: Mad Dogg Athletics, Inc., Venice, CA (US)

(72) Inventors: John Cook, Venice, CA (US); Ron Gibson, Venice, CA (US)

( * ) Notice: Subject to any disclaimer, the term of this patent is extended or adjusted under 35 U.S.C. 154(b) by 130 days.

(21) Appl. No.: 16/727,833

(22) Filed: Dec. 26, 2019

(65) Prior Publication Data

US 2020/0206563 A1 Jul. 2, 2020

Related U.S. Application Data

(60) Provisional application No. 62/784,982, filed on Dec. 26, 2018.

(51) Int. Cl.
*A63B 21/00* (2006.01)

(52) U.S. Cl.
CPC ..... *A63B 21/4039* (2015.10); *A63B 21/4035* (2015.10); *A63B 2225/09* (2013.01)

(58) Field of Classification Search
CPC ..... A63B 21/4039; A63B 21/4035; A63B 2225/09; A63B 21/00047; A63B 21/0023; A63B 21/4029
See application file for complete search history.

(56) References Cited

U.S. PATENT DOCUMENTS

| | | | | |
|---|---|---|---|---|
| 5,795,276 | A * | 8/1998 | Almeda | A63B 21/00047 482/140 |
| 5,925,003 | A * | 7/1999 | Vincent | A61H 1/0218 601/134 |
| 6,578,218 | B2 * | 6/2003 | Wassilefsky | A47C 20/021 5/630 |
| 7,563,217 | B2 * | 7/2009 | Endelman | A63B 21/00047 482/142 |
| D683,801 | S * | 6/2013 | Kalina | A63B 22/14 D21/662 |
| 2007/0117695 | A1 * | 5/2007 | Endelman | A63B 21/00047 482/140 |
| 2007/0197360 | A1 * | 8/2007 | Rester | A63B 21/00047 482/23 |
| 2008/0004167 | A1 * | 1/2008 | Endelman | A63B 21/00047 482/142 |
| 2008/0015096 | A1 * | 1/2008 | Isacowitz | A63B 21/04 482/130 |
| 2010/0152004 | A1 * | 6/2010 | Feltz | A63B 22/16 482/142 |
| 2013/0274078 | A1 * | 10/2013 | Andrews | A63B 21/4035 482/141 |
| 2019/0209423 | A1 * | 7/2019 | Mercenari Uribe | A63B 22/14 |

* cited by examiner

*Primary Examiner* — Andrew S Lo
(74) *Attorney, Agent, or Firm* — WPAT Law, P.C.; Anthony King

(57) ABSTRACT

A Pilates spine corrector having a user-adjustable handle assembly that rotates. The handle assembly has a grip bar that is eccentrically positioned such that it is off centered.

19 Claims, 7 Drawing Sheets

SPINE CORRECTOR HAVING ADJUSTABLE HANDLES

CROSS-REFERENCE TO RELATED APPLICATIONS

This application claims priority to, and is a non-provisional application of, U.S. Provisional Pat. No. 62/784,982, filed on Dec. 26, 2018, now pending, and is hereby incorporated by reference in its entirety.

FIELD OF THE DISCLOSURE

The field of the disclosure is exercise equipment in general and Pilates spine correctors specifically.

BACKGROUND OF THE DISCLOSURE

A spine corrector is often used in the practice of Pilates. There is a need to provide a spine corrector that can accommodate users with different arm lengths. There is also a need to provide a spine corrector that can accommodate different hand positions/angles when a user is in various bodily positions. There is a continuing need for a spine corrector with better mobility. Further, there is a need to easily store spine correctors.

All referenced patents, applications and literatures are incorporated herein by reference in their entireties. Furthermore, where a definition or use of a term in a reference, which is incorporated by reference herein, is inconsistent or contrary to the definition of that term provided herein, the definition of that term provided herein applies and the definition of that term in the reference does not apply. Any of the disclosed embodiments may seek to fulfill one or more of the above-mentioned needs. Although some of below disclosed embodiments may fulfill one or more of the above-mentioned needs, it should be understood that some aspects of these embodiments might not necessarily fulfill them.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the embodiments in any manner.

BRIEF SUMMARY OF THE DISCLOSURE

Figure 1:
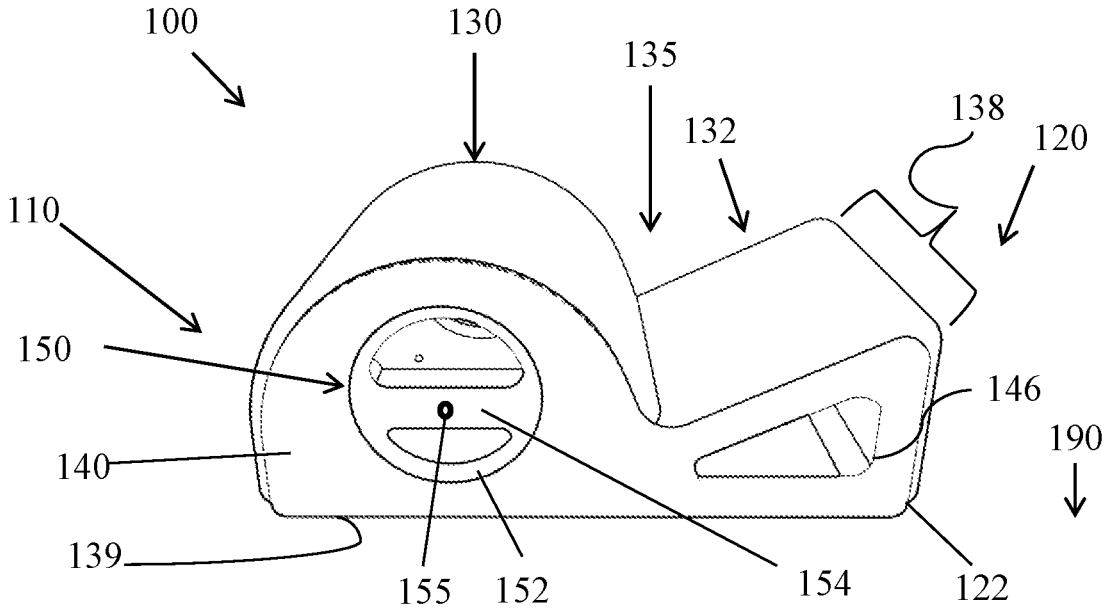
FIG. 1 is a side perspective view of an embodiment of a spine corrector having a rotatable handle assembly on each of its left and right side walls according to an aspect of the embodiment.

The words used in this specification to describe the various embodiments are to be understood not only in the sense of their commonly defined meanings but to include by special definition in this specification the structure, material or acts beyond the scope of the commonly defined meanings. Thus, if an element can be understood in the context of this specification as including more than one meaning, then its use in a claim must be understood as being generic to all possible meanings supported by the specification and by the word itself.

The inventors have created a Pilates spine corrector having an adjustable handle assembly suitable for users whose arm lengths may be different from one user to another. Also, the contemplated adjustable handle assembly allows the same user to adjust the relative position and angle of the grip bar to accommodate different exercises.

One embodiment of the contemplated Pilates spine corrector can have a top side coupled to a left side wall and a right side wall, and there can be a bottom side coupled to the left side wall and the right side wall. A user is contemplated to place the bottom side on the floor in order to carry out exercise routines. There can be a head end coupled to the top side and a tail end coupled to the top side. Also, it is contemplated that individually both the left side wall and the right side wall can have a handle assembly disposed thereon.

The contemplated handle assembly can have a user-adjustable grip bar. In some embodiments each grip bar can have a first terminal end, a second terminal end, and a center point equidistant from the first terminal end and from the second terminal end.

In further embodiments of the Pilates spine corrector, each of the grip bars can have a longitudinal axis; this axis can have a user-adjustable angle relative to the floor.

In still another embodiment, the center point of the grip bar can be user-adjusted to various distances relative to the head end of the Pilates spine corrector.

In another contemplated embodiment, the center point of the grip bar can be user-adjusted to various distances relative to the bottom side of the Pilates spine corrector.

The contemplated embodiments of the Pilates spine corrector can have a receiving structure on each of the left side wall and the right side wall; each of the handle assemblies can have an engagement mechanism making engaging contacts and adjustable contacts with a receiving structure of respective corresponding left and right side walls.

In a further contemplated embodiment, the engagement mechanism in the Pilates spine corrector can be a circular structure that fits within the opening of a side wall. The circular structure can rotate within the opening. In yet another embodiment, the circular structure can freely rotate within the opening without having a locking structure such as teeth or catches.

Each of the grip bars can be eccentrically attached to the corresponding circular structure such that the center point of each grip bar is offset from a rotational axis of each circular structure.

In another embodiment, the Pilates spine corrector can have handle assemblies that are rotatable around an axis which is substantially parallel to the bottom side of the Pilates spine corrrector.

In one way, each handle assembly can be flush with an outer surface of the side wall. In another way, each handle assembly can be recessed from the outer surface of the side wall.

Another aspect of the embodiments is directed to an ergonomic method of using a Pilates spine corrector. Another aspect of the embodiments includes a method of effectively storing more than one Pilates spine corrector.

In a particular embodiment, the handle assembly can be flush or recessed from the side wall. In this way, one Pilates spine corrector can be stacked on top of another on their sides.

In another embodiment, each handle assembly can have a circular rim and a grip bar disposed within the rim; the grip bar can be disposed off-center within the rim. The grip bar can have a center point and the distance between the center point and the floor can change as the handle assembly rotates.

In a further aspect of the embodiments, the rim of the handle assembly can have a groove to receive an edge of a through-hole within which the handle assembly is disposed. For example, the groove can be a U-shaped groove with a continuously smooth bottom surface; the edge of the through-hole can be a circular opening without any teeth or catches.

Many alterations and modifications may be made by those having ordinary skill in the art without departing from the spirit and scope of the disclosure. Therefore, it must be understood that the illustrated embodiments have been set forth only for the purpose of example and that it should not be taken as limiting the embodiments. For example, notwithstanding the fact that the elements of a claim are set forth below in a certain combination, it must be expressly understood that the disclosed embodiments include other combinations of fewer, more, or different elements, all of which are disclosed herein even when not initially claimed in such combinations.

DETAILED DESCRIPTION

Referring now to FIG. 1, a Pilates spine corrector 100 is shown having a top side coupled to a left side wall (not shown) and a right side wall 140, which is opposite to the left side wall. The top side can include an arcuate surface creating a hump 130. There can be an angled flat surface 132 adjacent to the arcuate surface 130, and a valley 135 is created at the junction between the hump 130 and the angled flat surface 132.

The angled flat surface 132 is coupled to a flat vertical wall 122; the junction between the angled flat surface 132 and the flat vertical wall 122 forms a ridge 138. For purposes of discussion, the flat vertical wall 122 is the tail end 120 whereas the opposite end is the head end 110. During use a user may sit or lay anywhere on the top side, including on the hump 130, in the valley 135, or on the angled flat surface 132. Depending on the particular exercise routine, the user's foot may be oriented towards the head end 110 or towards the tail end 120 of the Pilates spine corrector 100.

The general shape of the Pilates spine corrector 100 is described above; it should be noted that other shapes are also contemplated. For example, there may or may not be a hump 130, or there can be more than one hump 130. The shape of the hump 130 can be angular or even spherical. There may or may not be an angled flat surface 132; there may be more than one angled flat surface 132. Also, while the bottom side 139 is shown as being flat, it can have other shapes or may even have legs.

The bottom side 139 can be coupled to the left side wall and the right side wall 140, which is a mirror image of the left side wall. The left side wall and the right side wall 140 can be oriented perpendicularly or slightly slanted to the bottom side 139.

A user is contemplated to place the bottom side 139 of the Pilates spine corrector 100 on the floor 190 in order to carry out exercise routines. It is contemplated that each of the left side wall and the right side wall 140 can have a handle assembly 150 disposed thereon.

There can also be a rear side opening 146 disposed on each of the left and right side walls 140. A user may insert his or her hand into the rear side opening 146 to carry the spine corrector 100.

The contemplated handle assembly 150 can be user-adjustable in terms of its relative orientation to the side wall 140. In other words, a user may adjust the angle or position of the grip bar 154 at will. In FIG. 1, the grip bar 154 is disposed within a rim 152 of the handle assembly 150. The grip bar 154 can have a first terminal end, a second terminal end, and a center point 155 which is equidistant to the first terminal end and the second terminal end.

User-adjustable is defined as the ability for a user to make adjustment without the use of any tools. In one embodiment, the handle assembly 150 can be user-adjustable while the user is using the contemplated spine corrector 100. In another embodiment, the handle assembly 150 can be user-adjustable while the user's body is resting on top of the spine corrector 100.

The first terminal end is limited by the junction between the grip bar 154 and the rim 152. Likewise, the second terminal end is also limited by the junction between the grip bar 154 and the rim 152. The first and the second terminal ends are disposed on opposite sides of the grip bar 154.

Figure 2:
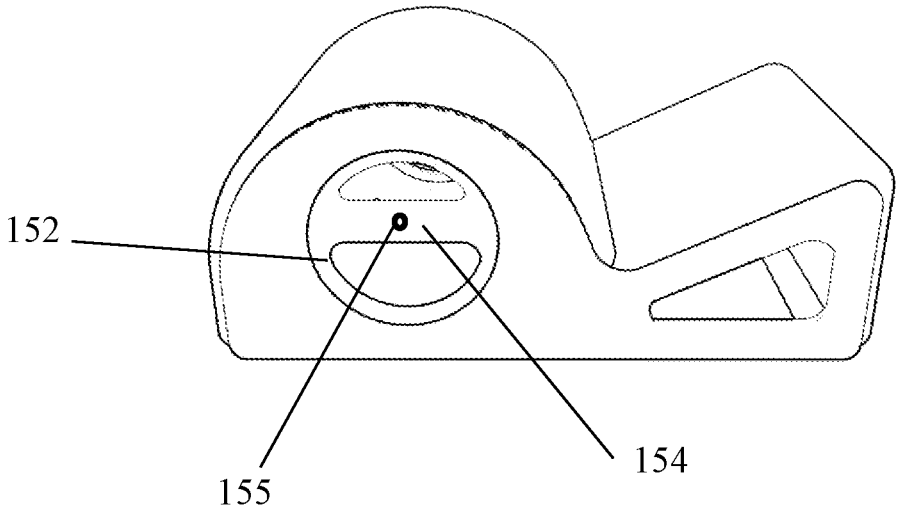
FIG. 2 is a side perspective view of the embodiment of FIG. 1 where the grip bar of the handle assembly has been rotated and is now at a position further from the floor when compared to the position of the grip bar as shown in FIG. 1.

The grip bar 154 can generally be a straight structure capable of being held by a user's hand. It can be cylindrical and can have generally the same diameter throughout the entire length of the grip bar 154. In one embodiment, the grip bar 154 can have a longitudinal axis which is always oriented in parallel with the plane of the side wall 140, even as the grip bar 154 rotates into various different positions relative to the side wall 140. For example, in FIGS. 1-4, the handle assembly 150 is shown being rotated in various orientations. In FIG. 1, the grip bar 154 is shown being generally horizontal relative to the floor 190. In comparison, the grip bar 154 in FIG. 2 is also generally horizontal relative to the floor 190 but the handle assembly 150 has in fact rotated 180 degrees. The center point 155 of the grip bar 154 in FIG. 2 is at a higher position relative to the floor than that shown in FIG. 1. In other words, by rotating the handle assembly 180 degrees, the distance between the center point 155 to the floor 190 is changed. This can be helpful for users to adjust the handle assembly 150 so the grip bar 154 can be at a suitable or comfortable distance from the user.

Figure 3:
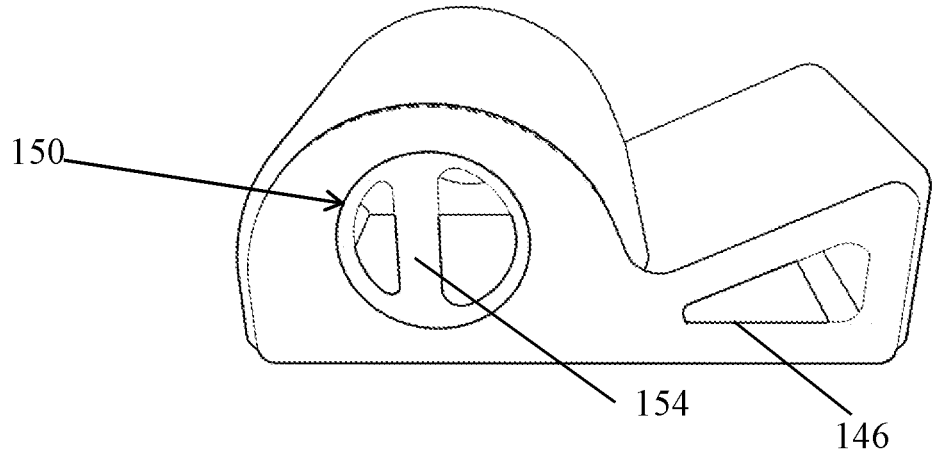
FIG. 3 is a side perspective view of the embodiment of FIG. 1 where the grip bar is now positioned vertically with a slight angle, according to an aspect of the embodiment.
Figure 4:
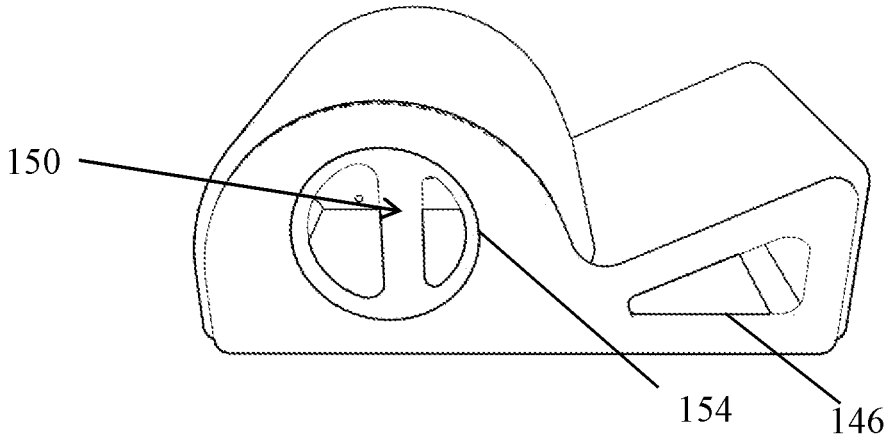
FIG. 4 is a side perspective view of the embodiment of FIG. 1 where the grip bar is now positioned vertically with a slight angle and is further away from the head end of the spine corrector when comparing to what's shown in FIG. 3, according to an aspect of the embodiment.

In the examples of FIGS. 3 and 4, the handle assembly 150 shown in FIG. 3 is 180 degrees different from that shown in FIG. 4. These two orientations can be suitable in an exercise routine where the user sits in the valley 135 facing the head end 110. In one contemplated exercise routine, a user can sit on the hump 130 facing upward holding his or her body in a firm "plank" stance with his or her knees held above the ridge 138 and his or her head tilted backwards touching the floor 190. A user with a short arm length may choose to place the handle assembly 150 in the position as shown in FIG. 3. A user with a longer arm length may choose to place the handle assembly 150 in the position as shown in FIG. 4 because the grip bar 154 is slightly further away from the user's shoulders. In essence, the user may freely adjust the angle of the grip bar 154 into a more ergonomic position.

One of ordinary skill in the art would immediately recognize that, as a user moves about the Pilates spine corrector 100 in different bodily positions, he or she can freely change the angle of the grip bar 154 and/or adjust the distance between the grip bar 154 and his or her body.

Figure 5:
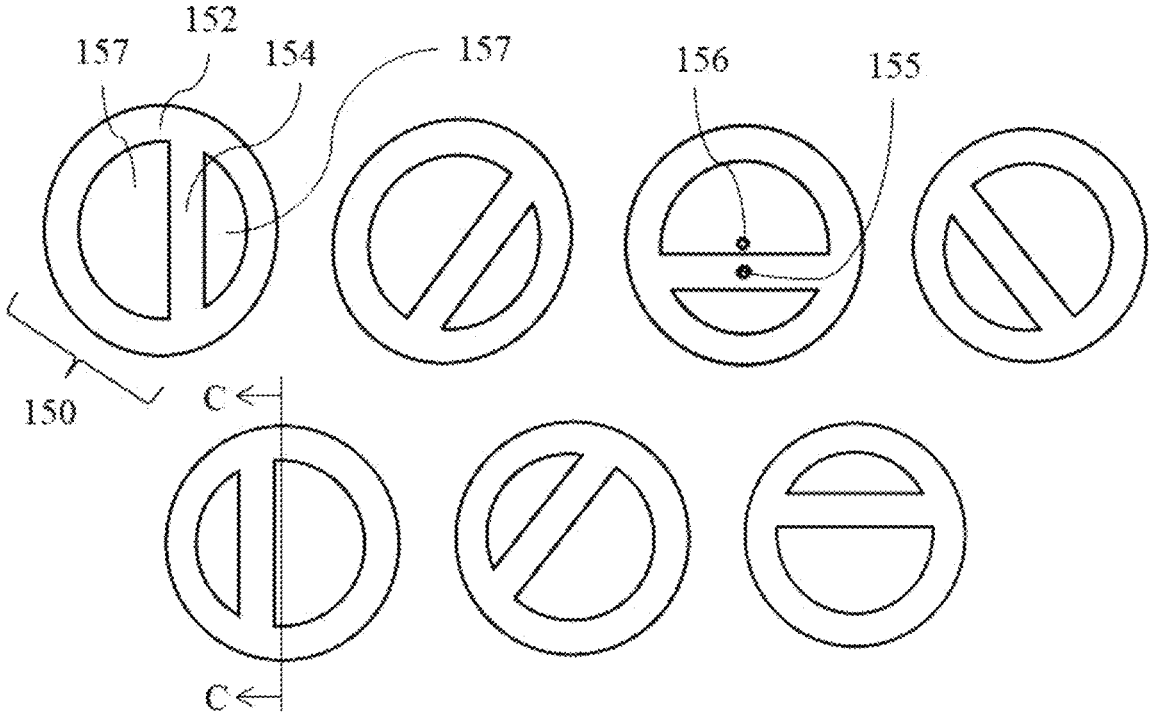
FIG. 5 illustrates the various positions as the grip bar rotates, according to an aspect of an embodiment.

FIG. 5 illustrates the various positions of the grip bar 154 as the handle assembly rotates in a clockwise direction. This embodiment can offer a simple and effective way to provide adjustability in the relative orientation/position of the grip bar 154 in a Pilates spine corrector 100. Here, the longitudinal axis of the grip bar 154 can be positioned at various angles relative to the floor 190. Empty space 157 can be disposed between the grip bar 154 and the rim 152.

Essentially, the distance and angle of the grip bar 154 can be user-adjusted relative to any part of the Pilates spine corrector 100; for example, an angle/distance relative to the head end 110, to the tail end 120, to the hump 130, to the ridge 138, to the valley 135, and to the bottom side 139.

The grip bar 154 can be eccentrically attached to the rim 152 such that the center point 155 of the grip bar 154 is offset from the rotational axis 156 (see FIG. 5) of the handle assembly 150. In other words, when the handle assembly 150 rotates along a rotational axis, the center point 155 of the grip bar 154 is off-set from the rotational axis. In other words, when the handle assembly 150 rotates, the center point 155 is not the rotational axis 156.

Figure 6:
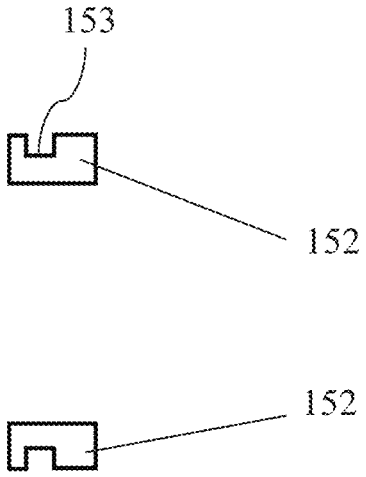
FIG. 6 is a cross-sectional view of the handle assembly along line C of FIG. 5.

FIG. 6 is a cross-sectional view of line C in FIG. 5. FIG. 6 illustrates one embodiment of the handle assembly 150 which can have a groove 153 along the periphery of the rim 152. The groove 153 or the rim 152 can have a U cross-sectional shape as that shown.

The groove 153 can be an outward-facing arcuate surface without any ridges or notches. It can be a continuous smooth arcuate surface that resembles a top surface of a wheel.

In another embodiment, the groove 153 can have notches, teeth, ridges, or have a polygonal shape when viewed perpendicular into the figure in FIG. 5. The polygonal shape has multiple small ridges to increase friction.

Figure 7:
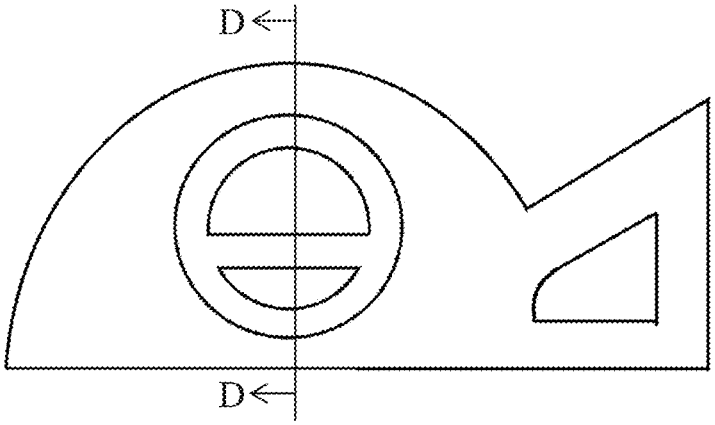
FIG. 7 is a plan side view of a spine corrector, according to an aspect of an embodiment.

FIG. 7 shows a side view of a Pilates spine corrector 100 and the grip bar 154 positioned in a horizontal position relative to the bottom side 139.

Figure 8:
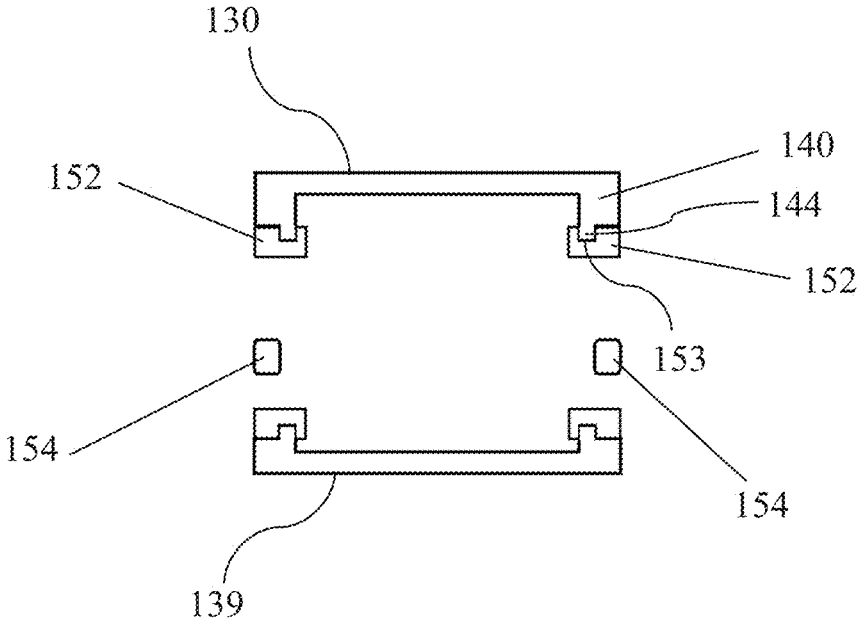
FIG. 8 is a cross-sectional view of the spine corrector along line D of FIG. 7, according to an aspect of another embodiment.

FIG. 8 is a cross-sectional view along line D of FIG. 7. Here, the side wall 140 of the Pilates spine corrector 100 can have a circular through hole as the receiving structure to receive and engage with a handle assembly 150. The through hole can have a circular shape (with or without teeth/angles), allowing the groove 153 of the handle assembly 150 to frictionally engage. The through hole of the side wall 140 can have a track 144 along the circular edge of the through hole, and the track 144 can fit within the groove 153 of the handle assembly 150.

In one particular embodiment, the track 144 can be perfectly circular without any teeth or angles. Track 144 freely slides along groove 153, essentially allowing the handle assembly 150 to freely rotate within the through opening. Groove 153 can also be perfectly circular without any teeth or angles. This particular embodiment is ideal, allowing for microadjustment of angles.

In some embodiments, the contact surfaces of the track 144 and/or the groove 153 can be made of (or covered by) a suitable material (e.g., wood, plywood, composite material, rubber) that creates an ideal or efficient amount of load-bearing friction so when a user applies a force on the handle assembly 150 (e.g., pulls the grip bar 154 towards the tail end 120), the handle assembly stays in position without the need for any mechanical locking mechanism such as gear teeth, a catch, or an insertable locking peg. In this particular embodiment, the user can simply turn the grip bar 154 (while he or she is laying on top of the spine corrector 100) to an angle that makes his or her wrist feel neutral or natural. To keep the grip bar 154 in the desired angle, he or she would not need to press a lever or insert a peg, or move certain mechanical means into a locking gear. Here, as he or she naturally exerts pressure on the grip bar 154 (as he or she try to stabilize his or her body as part of the exercise routine), the aforementioned friction keeps the handle assembly from rotating.

One important feature of some embodiments is that the handle assembly 150 does not lock into any position while at rest nor does it have the ability to be locked into any position while at rest. In other words, there can be no gear teeth, no angular catches, no locking taps of any kind.

In one embodiment of the disclosure, the coefficient of friction between the contact surface of the rotatable handle assembly 150 and the contact surface of the side wall 140 can be between 0.15 and 1.5. In another embodiment the coefficient of friction can be between 0.2 and 0.8. In yet another embodiment the coefficient of friction can be between 0.2 and 0.6. In still yet another embodiment the coefficient of friction can be between 0.15 and 0.5. In a further embodiment the coefficient of friction can be between 0.2 and 0.3. In other embodiments the coefficient of friction can be between 0.25 and 0.5; in a still further embodiment, it can be between 0.25 and 0.35. In a contemplated embodiment, there can be no lubrication or grease between the two contact surfaces.

In other embodiments, the contact surfaces of the track 144 and/or the groove 153 can be made of a suitable material or have bearings to minimize friction so even when a user applies a force onto the handle assembly 150 (e.g., pulls the grip bar 154 towards the tail end 120), the handle assembly does not easily stay in position and can still freely rotate.

The embodiment as shown in FIG. 8 has two handle assemblies 150 being physically separate from each other. A first handle assembly 150 being disposed on the left side wall and the second handle assembly 150 being disposed on the right side wall 140. Each handle assembly 150 has a plane of rotation parallel to a plane of the perspective side wall 140. In another embodiment, each handle assembly 150 has a plane of rotation perpendicular to the bottom side 139 of the Pilates spine corrector 100.

In this embodiment, a user can separately and individually rotate the two handle assemblies 150 in different directions and into different angles without interfering with the other.

In another embodiment, these two separate handle assemblies 150 can be tethered to each other via a resilient cord (not shown) such as a bungee cord, biasing them towards the interior space of the spine corrector 100.

Figure 9:
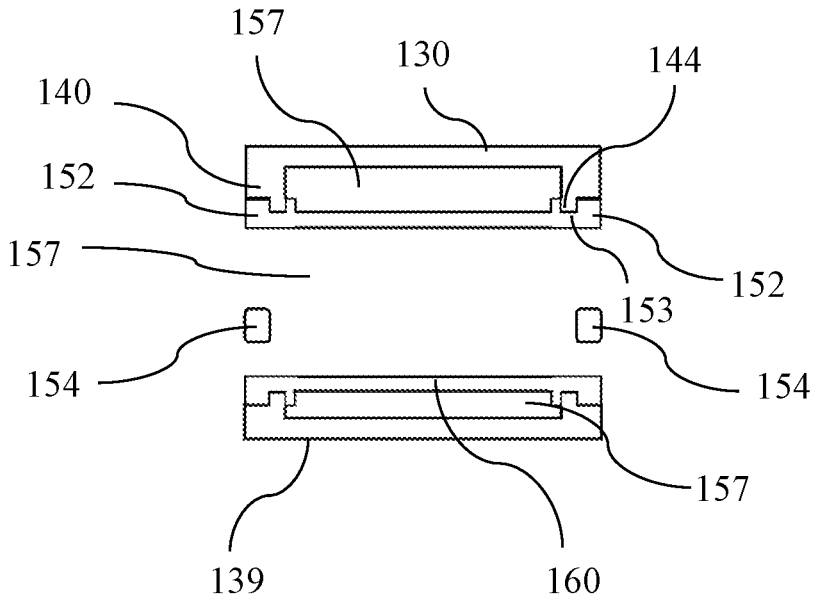
FIG. 9 is a cross-sectional view of the spine corrector along line D of FIG. 7, according to an aspect of yet another embodiment.

In contrast, FIG. 9 shows another embodiment where the two handle assemblies 150 are an integral part of a single cylinder 160. The cylinder 160 can have a hollow center (i.e., empty space 157) and openings on its two terminal ends. There is also empty space 157 above and below the cylinder 160. A grip bar 154 is disposed on each terminal end of the cylinder 160, and a circular groove 153 is provided on each terminal end of the cylinder 160 to engage with the circular track 144 of the left and right side walls 140 as similarly described above. In this particular embodiment, the two grip bars 154 must turn together because they are integral parts of the same cylinder 160.

Figure 10:
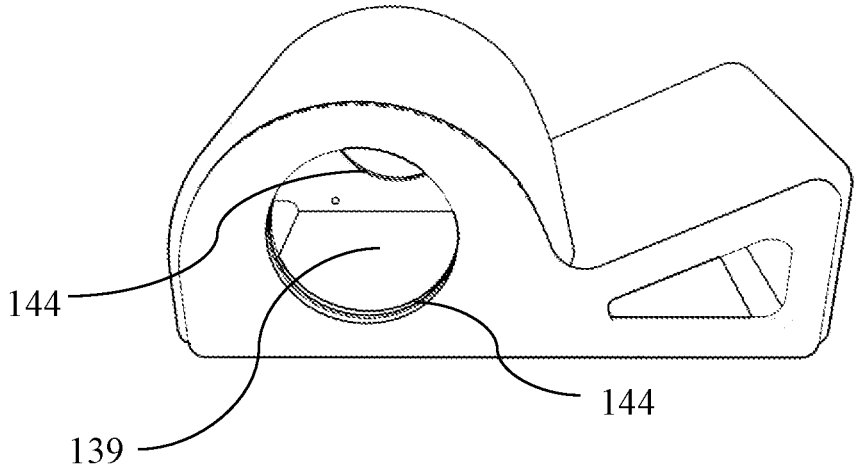
FIG. 10 is a side perspective view of the spine corrector of FIGS. 7 and 8, with the handle assembly removed, according to an aspect of yet another embodiment.

FIG. 10 shows a spine corrector 100 with handle assemblies 150 removed. It shows a hollow interior having circular openings on its side walls. The bottom 139 of the spine corrector 100 can be seen through the circular opening. Circular tracks 144 are disposed along the rim of the two circular openings.

Figure 11:
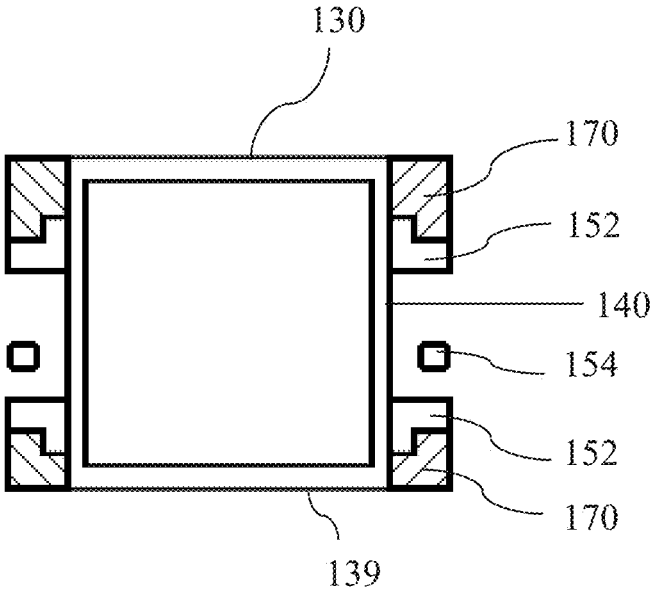
FIG. 11 is a cross-sectional view of the spine corrector along line D of FIG. 7, according to an aspect of another embodiment, where the handle assembly is sandwiched between a side wall and an outer board.

FIG. 11 illustrates another embodiment where the left and right side walls 140 are simply flat, and each handle assembly 150 is held in place by using outer board 170 that has a circular opening with corresponding track and groove shape to interconnect with the track and groove of the handle assembly 150.

It should be particularly noted that although the embodiments shown in the drawing figures has the groove 153 disposed on the handle assembly 150 and the track 144 disposed on the side wall 140, the opposite arrangement is also possible. For example, the side wall 140 can have a circular groove along the circular edge of its through opening to receive a circular track of the handle assembly 150. Also, other known mechanical structures suitable to allow the handle assembly 150 to rotate within the through opening of the side wall 140 are particularly contemplated. For example, more complex arrangements of a ball bearing, a swiveling joint, a rotating joint, or a spinning joint are contemplated for rotationally connecting the handle assembly 150 to the side wall 140.

One important aspect of the particularly illustrated embodiment is in its simplicity and cost effectiveness. The entire housing of the Pilates spine corrector 100 can be made of mostly, if not all, plywood. The entire housing includes the top side, the side walls 140, and the bottom side 139. The top side may be covered with fabric or other material. Circular through openings can be cut into the side walls 140, and each side wall 140 can include an additional inner layer of plywood having a slightly smaller but co-axial through hole, thereby creating the track 144 around the circular edge of each through opening. On the other hand, contemplated handle assembly 150 in this embodiment can simply be made of a circular disc-shaped wood piece with a grip bar 154 set between two through openings. The peripheral of the disc-shaped wood can be machined to create the groove 153 on the radially outward-facing side of the rim 152. The wood-on-wood contact of the track 144 and groove 153 can provide the contemplated friction to keep the handle assembly 150 in a particular position during an exercise routine when a user holds onto the grip bars 154. This is because when the user holds onto the grip bars 154, a force is naturally applied by the user to bias the handle assembly in some directions, causing friction in the track 144 and groove 153. Although this friction does not technically "lock" the handle assembly 150 into place, the friction is nevertheless sufficient enough such that the handle assembly 150 is stable and is "set" in place. When the handle assembly 150 is "set" in place, it cannot be easily rotated because of the friction created in the track 144 and groove 153. In this sense, the track 144 and groove 153 cannot serve the purpose to reduce rotational friction and support radial and axial loads. In this particular embodiment, the track 144 and groove 153 is to ensure that the handle assembly 150 rotates along the rotational axis and along the same plane. The track 144 and groove 153 can also serve the purpose of increasing rotational friction. This serves a purpose opposite of a ball bearing.

The simple manufacturing method described above provides a cost-effective and efficient way to produce an adjustable handle that can also be "set" in place when needed. It should be noted that a contemplated feature of some disclosed embodiments is that the user doesn't need to knowingly and selectively "set" or "lock" the handle assembly 150 in place. The "setting" happens automatically as a result of the user leaning on or holding on to the grip bar 154. When a user leans on or holds on to the grip bar 154 during a routine exercise on the Pilates spine corrector 100, the force applied to the grip bar 154 by the user as a result of simply leaning on or holding on to the grip bar 154 creates sufficient rotational friction. This is contrary to ordinary wisdom in rotational handles where a smooth or decreased rotational friction is typically sought for.

To achieve the same purpose of increasing rotational friction, the handle assembly 150 can also be injection-molded or via other manufacturing methods using any known materials so long as the track 144 and groove 153 contact surfaces are provided with a material (e.g., felt fabric, rubber) to achieve substantially the same result.

Another aspect of the disclosure is directed to methods of using a Pilates spine corrector 100. Known Pilates spine correctors have side handles for a user's stability. These known side handles, however, are not readily adjustable by a user during an exercise routine. A typical handle is one that is screwed onto the side wall of a Pilates spine corrector and its handle grip bar is typically oriented vertically relative to the floor. An important part of any exercise routine performed on a Pilates spine corrector is the ability to stabilize one's body while the body is in some way leaned or placed on the Pilates spine corrector, it is commonly believed in the art that the handle of a Pilates spine corrector be necessarily stable and fixed in place. It cannot and should not wobble and cannot have any loose parts. Any Pilates spine corrector with a loose handle would be immediately rejected by the user. Not only would it be unsafe, it would also cause incorrect body posturing if the handle is not fixed in place. Therefore, any type of loose, removable, movable, detachable handles would be directly against the conventional understanding and wisdom for those in the art.

The inventor has discovered an unconventional way to use a Pilates spine corrector by providing a handle assembly 150 that is actually movable, rotatable, and adjustable. In one embodiment, the handle assembly 150 can freely rotate relative to the side wall 140 at rest but is incapable of rotating when a user applies force onto the grip bar 154. There are many ways to achieve this. One embodiment includes using track 144 and groove 153 as described above.

Another embodiment includes using wood as the material on the contact surfaces between the track 144 and groove 153. In yet another embodiment, any suitable material capable of increasing rotational friction can be used in the track 144 and groove 153. In still yet other embodiments, there can be mechanical gear teeth, catches, pegs insertable into positioning holes, or other similar structures allowing the handle assembly 150 to mechanically engage with the side wall into a locked position, and this allows the user to quickly disengage thereby unlocking the handle assembly 150 from the side wall 140, allowing the handle assembly 150 to freely rotate again.

Figure 12:
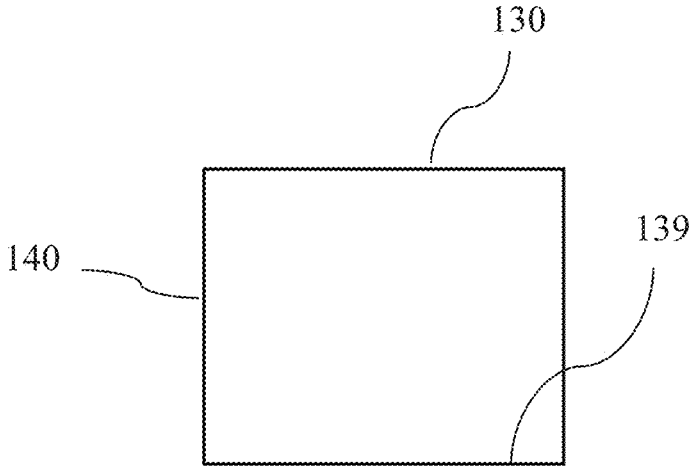
FIG. 12 is a plan frontal view (head-end view) of a spine corrector, according to an aspect of an embodiment.
Figure 13:
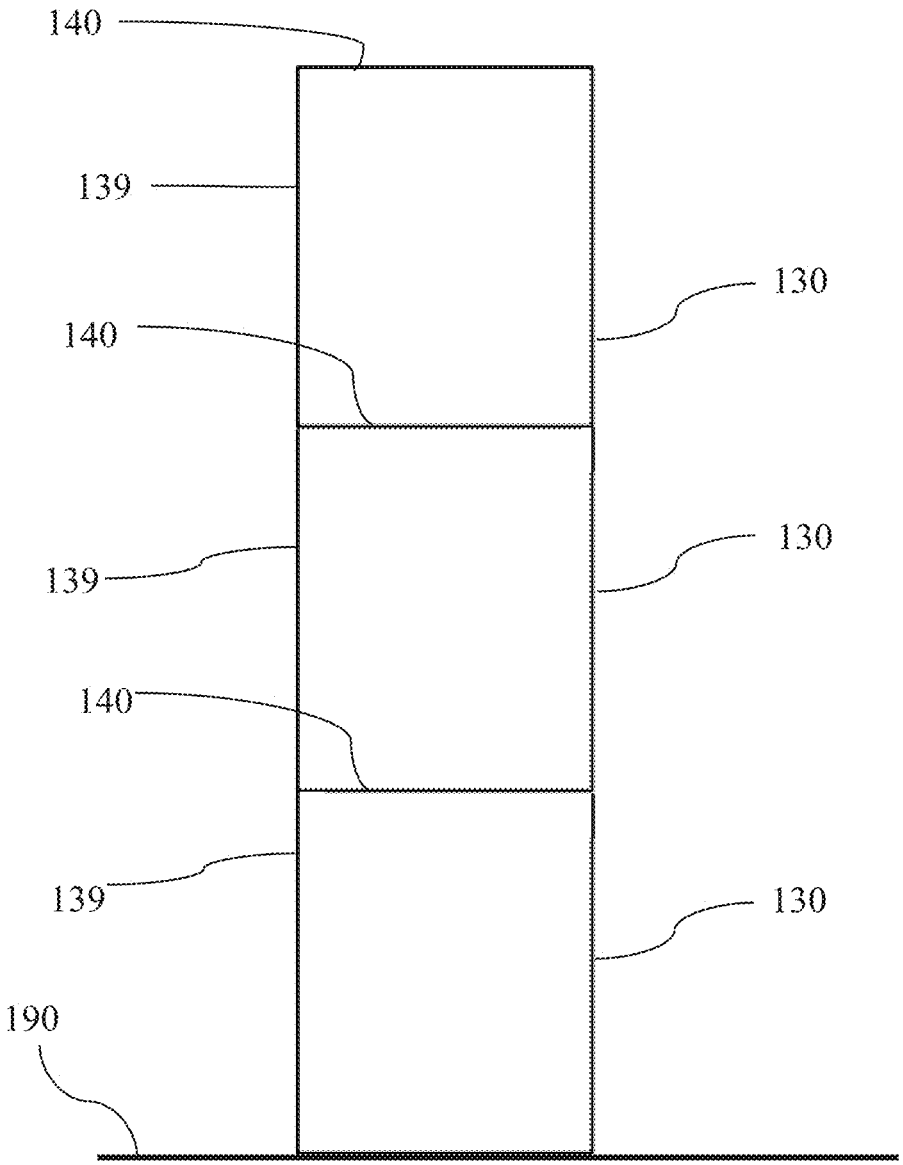
FIG. 13 is a plan frontal view (head-end view) of three spine correctors stacked on their sides, according to an aspect of an embodiment.

FIG. 12 shows that the spine corrector 100 can have a squarish or retangular profile to facilitate easy storage. In FIG. 13, multiple spine correctors 100 can be stacked on its sides 140 because the side walls 140 are flat without any protruding handles.

In one way, each handle assembly 150 can be flush with an outer surface of the side wall 140. In another way, each handle assembly 150 can be recessed from the outer surface of the side wall 140.

The definitions of the words or elements of the following claims therefore include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

What is claimed is:

1. A Pilates spine corrector comprising:

a top side coupled to a left side wall and a right side wall;

a bottom side coupled to the left side wall and the right side wall;

a head end coupled to the top side and a tail end coupled to the top side; and wherein each of the left side wall and the right side wall has a handle assembly disposed thereon;

wherein each of the handle assemblies is user-adjustable;

wherein each of the handle assemblies has a frame and a grip bar which has a first terminal end and a second terminal end both of which are directly attached to the frame;

wherein the grip bar has a center point equidistant to the first terminal end and the second terminal end.

2. The Pilates spine corrector as recited in claim 1, wherein each of the grip bar has a longitudinal axis positioned at an angle relative to a floor, and the angle is user-adjustable.

3. The Pilates spine corrector as recited in claim 1, wherein each of the center points is positioned at a distance X relative to the head end of the Pilates spine corrector, and the distance X is user-adjustable.

4. The Pilates spine corrector as recited in claim 1, wherein each of the center points is positioned at a distance Y relative to the bottom side of the Pilates spine corrector, and the distance Y is user-adjustable.

5. The Pilates spine corrector as recited in claim 1 further comprising a receiving structure on each of the left side wall and the right side wall, and wherein each of the handle assemblies has an engagement mechanism making engaging and adjustable contacts with the receiving structure of respective corresponding side walls to which the handle assembly grip bar is disposed thereon.

6. The Pilates spine corrector as recited in claim 5, where each of the engagement mechanisms is a circular structure that fits within an opening of the corresponding side wall to which each handle assembly is disposed thereon, and the circular structure rotates within the opening.

7. The Pilates spine corrector as recited in claim 6, wherein each of the grip bars is eccentrically disposed within the handle assembly such that the center point of the grip bar is offset from a rotational axis of the handle assembly.

8. The Pilates spine corrector as recited in claim 2, wherein each of the handle assemblies is rotatable and has a plane of rotation parallel to a plane of the perspective side wall.

9. The Pilates spine corrector as recited in claim 8, wherein each handle assembly is either flush with an outer surface of its respective side wall or recessed from the outer surface.

10. An exercise device comprising:

a bottom side;

a tail end coupled said bottom side;

a top side coupled to the tail end and the top side includes an arcuate surface;

a left side wall coupled to said bottom side;

a right side wall coupled to said bottom side;

a handle assembly disposed on or within each of said left side wall and right side wall;

said handle assembly is rotatable relative to its respective left side wall and right side wall, and each said handle assembly handle assembly has a grip bar with a longitudinal axis, wherein when said handle assembly rotates, a relative angle of the longitudinal axis to the bottom side changes; and wherein the grip bar has a center point equidistant to a first terminal end and a second terminal end of the grip bar, and said handle assembly rotates around an rotational axis which is perpendicular to a plane of the respective left and right side wall to which the handle assembly is attached to;

wherein the handle assembly has a contact surface that physically contacts a surface of the respective left and right side wall, either at rest, during operation, or both, and wherein an interface between the contact surface of the handle assembly and the surface of the respective left and right side wall is arcuate.

11. The device as recited in claim 10, wherein a coefficient of friction between the contact surface of the handle assembly and the surface of the respective left and right side wall is between 0.15 and 1.5.

12. The device as recited in claim 11, wherein the coefficient of friction is between 0.25 and 0.5.

13. The device as recited in claim 10, wherein the handle assembly is freely rotatable and is not locked into any orientation at rest.

14. The device as recited in claim 10, wherein the device has no mechanical means to lock the handle assembly into any fixed orientation, either at rest, during operation, or both.

15. The device as recited in claim 14, wherein a coefficient of friction between the handle assembly and its respective side wall is such that the handle assembly can freely rotate at rest and when a user pulls or pushes on the handle assembly during operation, a friction between the handle assembly and the respective left and right side wall causes the handle assembly to become non-rotatable.

16. The device as recited in claim 15, wherein each of said left and right side wall has an opening, and the contact surface of the handle assembly is a radially outward-facing side of the handle assembly, and the surface of the side wall is an inward-facing side of the opening.

17. The device as recited in claim 10, wherein the center point of the grip bar is disposed off-center within a circular frame such that the center point is not co-axial with the rotational axis.

18. The device as recited in claim 17, wherein as the handle assembly rotates, a distance between the center point and the bottom side of the device changes.

19. The device as recited in claim 18, wherein each of said left and right side walls has an opening and the opening is circular and the handle assembly makes direct frictional contact with an inward facing side of the circular opening.

* * * * *